US006378587B1

(12) United States Patent
Frist

(10) Patent No.: US 6,378,587 B1
(45) Date of Patent: Apr. 30, 2002

(54) CYLINDRICAL CONTAINER LABELING MACHINE

(76) Inventor: Daniel J Frist, 263 Concord Church, Pickens, SC (US) 29671

( * ) Notice: Subject to any disclaimer, the term of this patent is extended or adjusted under 35 U.S.C. 154(b) by 0 days.

(21) Appl. No.: 09/439,521

(22) Filed: Nov. 12, 1999

Related U.S. Application Data

(60) Provisional application No. 60/108,464, filed on Nov. 13, 1998.

(51) Int. Cl.[7] ..... B65C 9/00; B65C 9/08; B65C 9/10

(52) U.S. Cl. ..... 156/363; 156/379; 156/556; 156/564; 156/566; 156/DIG. 28

(58) Field of Search ..... 156/351, 363, 156/379, 556, 558, 564, 566, 569, 573, DIG. 28, DIG. 24

(56) References Cited

U.S. PATENT DOCUMENTS 707,738 A * 8/1902 Warren ..... 156/485
3,451,523 A * 6/1969 Evans, Jr. et al. ..... 198/394
3,928,115 A * 12/1975 Kerwin ..... 156/163
4,124,429 A * 11/1978 Crankshaw ..... 156/364
4,473,429 A * 9/1984 Crankshaw ..... 156/483
4,591,403 A * 5/1986 Von-Meyer ..... 156/364
4,647,333 A * 3/1987 Voltmer et al. ..... 156/351
5,810,955 A * 9/1998 Seibert et al. ..... 156/64

* cited by examiner

*Primary Examiner*—Richard Crispino
*Assistant Examiner*—Sue A. Purvis
(74) *Attorney, Agent, or Firm*—Michael A. Mann; Timothy J. Slabouz; Nexsen Pruet Jacobs and Pollard LLC

(57) ABSTRACT

A cylindrical container labeler includes a horizontal conveyor, a pair of separately controllable vertical coveyors at the front end of the conveyor to rotate the container into the correct oreintation, bail lifter following the vertical conveyors for moving the bail to the rearward side of the pail as it travels along the horizontal conveyor, a label magazine adjacent to the conveyor, a label transfer mechanism to move a label from the magazine into position at the conveyor, apply a thin coating a adhesive to the label and adhere it the side of the container. The container is oriented by operating the two vertical conveyors at different speeds.

17 Claims, 2 Drawing Sheets

CYLINDRICAL CONTAINER LABELING MACHINE

CLAIM TO PRIORITY

The Inventor claim Nov. 13, 1998, the filing date of U.S. Provisional Application, Ser. No. 60/108,464, as a priority date for their invention. The provisional application is hereby incorporated in its entirety by reference.

FIELD OF THE INVENTION

The present invention relates to labeling machines. In particular, the present invention relates to machines that apply labels to cylindrical containers such as pails, drums and the like.

BACKGROUND OF THE INVENTION

Many products are sold in cylindrical containers and drums, or "pails". Pails typically have accurate handles, or "bails", that run from one side near the top of the pail to the opposing side. These bails are attached to projections, sometimes called "ears", near the tops of the pails just below the lids.

The pails are labeled with pre-printed labels carrying product information as well as the brand name of the product inside. These labels are applied to the pails using a cylindrical container labeling machine.

An example of a pail labeling machine is found in U.S. Pat. No. 4,591,403, issued to Anker Labelers Corp., in 1986.

There are several problems that can be encountered in pail labeling machines. First, the bails of the pails need to be vertical when the pail enters the labeling machine. The bail is used to orient the pail by lifting and turning the bail so that the label is attached at the right location on the pail. If the bail is not vertical, the label may not be attached at the right place, or the bail may be over the surface area where the label is to be placed.

The bails made by various manufacturers are not always of the same strength. If a bail were not strong enough, it might bend or twist out of shape, again potentially causing a malfunction of the machine or misalignment of the pail for labeling and reduced label wipe-on efficiency.

The rate of labeling depends in part on the speed of orientation and rotation. Orienting and turning the pails, using their handles, limits the speed at which the pails could be labeled.

Prior art labeling machines also used moving label magazines, which are slower, require more energy and have a potential for injury.

Prior art label delivery and transfer systems depend on the uniformity and tackiness of the glue for effective label picking and feeding and placement on the pails. If the glue was not sufficiently tacky, the label might not be picked out of the moveable label magazine immediately by the glue roller and consequently applied incorrectly, if applied at all. Finally, prior art labeling machines have been known to cause injury while operators attempt to correct the shortcomings addressed in the aforementioned paragraph.

Thus there remains a need for a pail labeler that addresses these shortcomings in the prior art.

SUMMARY OF THE INVENTION

According to its major aspects and broadly stated, the present invention is a cylindrical container labeling machine comprised of a horizontal conveyor, container orientation means at the front end of the conveyor, bail orientation means following the container orientation means, a stationary label magazine adjacent to the horizontal conveyor, label transfer means to move a label from the magazine into position on the conveyor and label application means to adhere the label to the container.

The container orientation means rotates the container using two pail-side-engaging, vertical conveyors moving at different, relative speeds. Each being driven by a separate motor. Preferably, the vertical conveyors operate in opposing directions. Once the machine senses that the container is properly oriented with the use of a sensor, detecting the projections which secure the bail, on the horizontal conveyor, both vertical conveyors commence to move at the same speed and in the same direction. The bail orienting means assures that the handle is on the side of the pail opposite that where the label is to be applied. Another need of the users of pails is to identify a "Baby-in-the-bucket" label, which is required by the government to be placed on all 5 gallon pails. This pail orientation means also ensures presence by this label using the means of orientation.

A feature of the present invention is the pail orientation means that does not depend on the strength or shape of the bail for orienting the pail only on its existence on opposite sides of the pail. This feature provides greater assurance that a variety of pails can be properly oriented before their labels are applied.

Another feature of the present invention is the label transfer mechanism. The present invention takes the labels from a stationary magazine and applies glue to them. The use of two feed rollers including two pivoting back pressure rollers to maintain alignment and non-slip contact between the label transferring system and the label helps to assure that the label will be applied correctly to the container.

Still another feature of the present invention is the brush to sweep the bail from the front of the pail as it moves along the horizontal conveyor to the rear of the pail. This feature provides a simple and reliable way of orienting the bail.

Still another feature of the present invention are the label gates, vertical endless conveyors with holes formed in their surfaces and with corresponding fans behind them to maintain a vacuum pressure on the opposing sides of the gates as the label is moved into position over the horizontal conveyor belt with respect to the oncoming container.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 1:
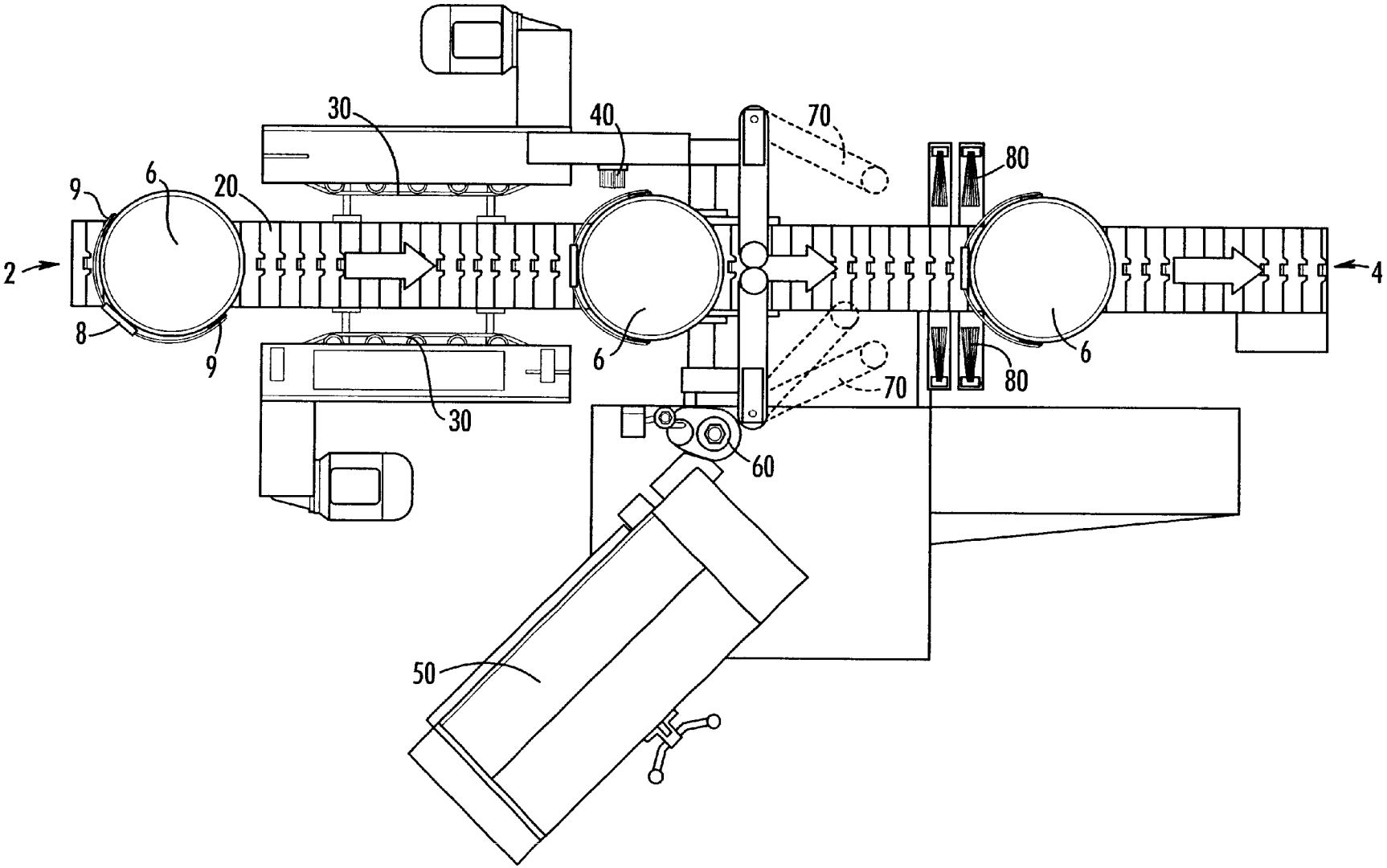
FIG. 1 is a top view of a cylindrical container labeling machine according to a preferred embodiment of the present invention.
Figure 2:
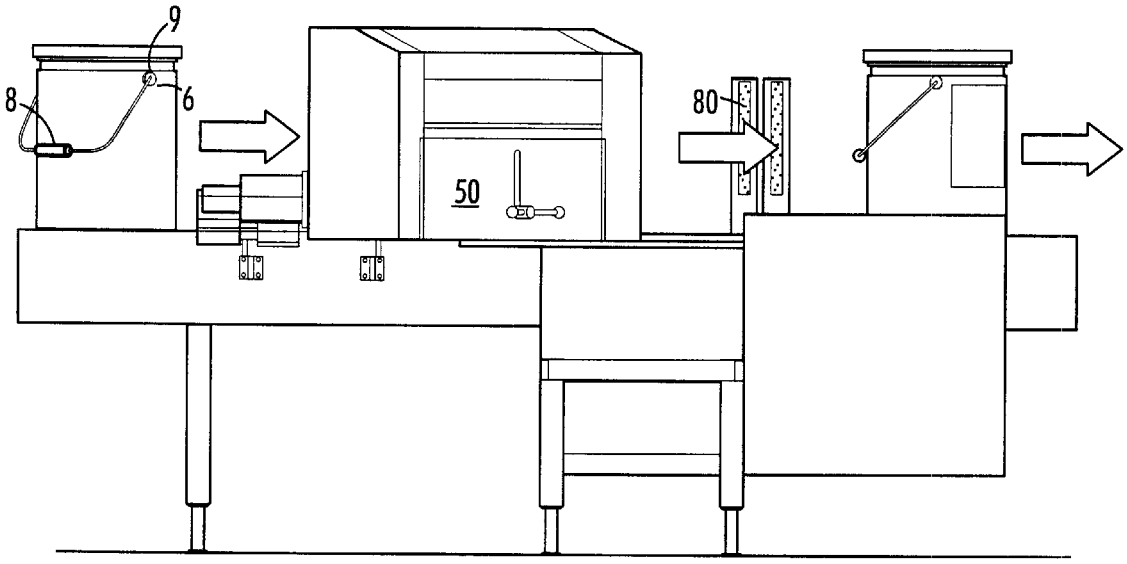
FIG. 2 is a right side view of a cylindrical container labeling machine according to a preferred embodiment of the present invention.
Figure 3:
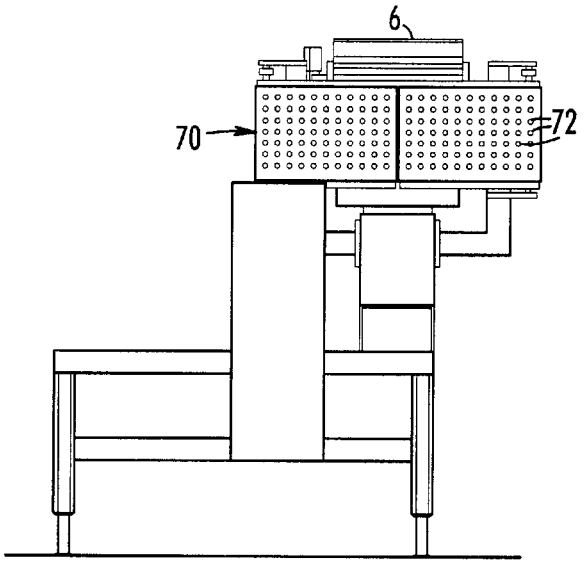
FIG. 3 is a rear view of a cylindrical container labeling machine according to a preferred embodiment of the present invention.

Referring now to FIGS. 1 and 2, the present invention is a cylindrical container labeling machine. It adheres labels onto the outside surfaces of cylindrical containers such a pails. The machine performs two functions prior to the application of the labels. First, it orients the containers so that the label is applied to the same side on each container. Second, it applies adhesive to the label.

The present machine performs one function after labeling; namely, it wipes or rolls the label tightly onto the container.

The pails are transferred through the machine from the entrance 2 of it to the exit 4 from it via a horizontal conveyor belt 20. The entrance 2 to the conveyor 20 where the pail 6 is placed is referred to as the orientation position. There the pail will be oriented automatically. Orienting the pail 6 means that it is rotated about a vertical axis so that the bail 8, or handle, is in the same location with respect to the direction of movement of the conveyor 20 for all pails, preferably where the two handle ears 9 define a line that is 90 degrees with respect to the direction of motion of the conveyor 20 carrying the pails 6. It does not matter at the orientation position on which side of the pail 6 the handle 8 is, the forward side or the rearward side of the pail 6. Reorientation of the bail 8 will be taken care of at a later point on the conveyor 20. If, however the user wants the by law required baby-in-the-bucket label always on the same side an optical label will be employed and an additional 180° rotation may be necessary.

In order to orient the pail 6, unlike the prior art devices which use the lifted bail 8 to rotate the pail 6 into the correct orientation, the present machine will engage the sides of the pail 6 with two independently controllable, vertical conveyor belts 30. These belts 30 are moved at different speeds relative to each other so that the pail 6 is rotated by friction of the belts 30 against its sides. Preferably, one belt rotates in the opposing direction of the other belt during the orienting and subsequently changes directions upon completion of the orientation. Alternatively, one belt can move in one direction and the other belt can be stationary.

To sense when the pail 6 is properly oriented, sensors on one or both sides of the conveyor detect the bail. Preferably these are pressure sensitive touch bars that respond to the pressure of the handle as it rotates into position and, upon sensing the handle on one or both sides, alter the speeds of the two vertical conveyor belts so that they are synchronized in terms of speed and direction. At that point, the pail stops rotating, maintains its corrected orientation and proceeds to advance to the next stage. Alternatively, the orientation can be guided by the positioning of labels on the pail. The label could be detected using a photoelectric sensor, and the pail rotated a certain measurement upon detecting the label. This is particularly useful where a label is placed in exactly the same place on every pail prior to entering the machine, such as the common "baby in a bucket" label. This label, which looks like a baby drowning in a pail is required by governmental regulations to be placed on the pail at a certain location.

Next a photoelectric sensor detects the location of the pail for engagement of the bail lifting device. If the bail 8 is on the forward side, that is, the leading side of the moving pail 6, a rotating brush 40 lifts the bail and sweeps it to the rear of the pail. The brush 40 moves horizontally and vertically about a horizontal axis perpendicular to the direction of pail 6 movement. The direction of movement of the brush 40 is selected to sweep the bail 8 to the rearward side of the advancing pail 6. If this brush 40 is on the left side of the advancing pail when viewed from behind, the brush 40 rotates counterclockwise so as to brush the bail 8 over the top of the pail 6 from front to back.

If the bail is already to the rear of the pail the sweeping motion of the brush will not result in a bail being lifted, as the bail is already in the desired location.

As the pail 6 is being oriented and the bail 8 is being swept to the rear of the pail, a label preparation system is selecting the next label, coating it with adhesive and orienting it for application to the pail. A label magazine 50 or hopper holds a supply of labels which may be plain paper printed with the desired text and do not have to be preglued labels. The magazine 50 preferably holds the stack of labels horizontally. The next label is selected from the top of the stack, preferably by a vacuum lifting system, lifted from the stack of labels and turned so that it is vertical. It is then advanced through a feed roller and over a glue roller 60 to a label gate 70.

The adhesive is a room temperature liquid that is pumped from a reservoir of glue onto the surface of a glue roller 60. The glue roller 60 is preferably made of brass and is kept constantly running. The excess glue is scraped from the surface of the glue roller 60 and returned to the glue reservoir, leaving a thin film of glue to apply to the next label as it passes in engagement with the glue roller.

The label is delivered from the magazine to the label gates 70 by a feed drive system, first to a nip cam where it is held securely indexed until a signal causes the rollers to advance it to the label gates 70. This feed drive system uses two rollers including one that is a pivoting back pressure roller to maintain slip-free contact between the label and the feed rollers.

The label gates consist of two endless conveyor belts oriented to have vertical surfaces. The belts have holes 72 formed in them that allows vacuum pressure to be applied to the labels to hold them to the belts as the belts move the labels into position over the horizontal conveyor belt 20. When the label is in position on the labeling gates, they are stopped to wait for the oncoming pail 6. Preferably photocells monitor the position of the label on the label gates 70 to signal that they be stopped when the label is positioned.

As the pail 6 pushes through the label gates 70, the label is applied to it. Subsequently, the pail passes through a set of high friction, vertical rollers or flappers that assure that the label is pulled onto the pail tightly. Preferably four rubber flappers or brushes are used, two on each side of the conveyor.

It will be apparent to those skilled in the art that many changes and substitutions can be made to the preferred embodiment herein described without departing from the spirit and scope of the present invention as defined by the appended claims.

What is claimed is:

1. A machine for applying labels to cylindrical containers, said machine comprising:

a first conveyor having a front end and an opposing back end;

means proximate to said front end of said first conveyor for rotating a container;

means in operative connection with said rotating means for sensing when said container rotated by said rotating means has rotated to a preferred orientation, said rotating means responsive to said sensing means, said rotating means halting the rotation of said container by said rotating means when said sensing means senses that said container has rotated so that the preferred side of said container is facing said back end of said conveyor;

a pair of opposing label gates positioned over said first conveyor, said label gates receiving a next label from a transferring means and holding said next label over said first conveyor until said container meets said next label; and means in spaced relation to said first conveyor for applying a label to the preferred side of said container.

2. The machine as recited in claim 1, wherein said rotating means is a pair of spaced apart conveyors oriented to engage the sides of said container when said first conveyor is conveying a container, said pair of conveyors capable of traveling at different speeds, said speeds of each conveyor of said pair of conveyors being different when said container is to be rotated and being the same when said container is to not rotate.

3. The machine as recited in claim 1, wherein said container has ears or a pre-printed mark and wherein said sensing means includes a sensing device and said rotating means rotates said container until said ears or mark of said container is sensed, whereupon said rotating means halts further rotation of said container.

4. The machine as recited in claim 2, wherein said container has ears or a pre-printed mark and wherein said sensing means may include a touch bar, and wherein said speeds of said two spaced apart conveyors are synchronized by said sensing means after said rotating means has rotated said pail far enough so that said ears or mark have been detected.

5. The machine as recited in claim 1, wherein said container has a bail, said machine further comprising means proximate to said first conveyor for sweeping said bail from the front of said container to the back of said container.

6. The machine as recited in claim 5, wherein said sweeping means is located next to said rotating means.

7. The machine as recited in claim 1, wherein said label applying means further comprises:

a magazine for holding a stack of labels, said magazine being proximate to said first conveyor;

means for applying adhesive to each label of said stack of labels, said label gates positioning said each label one at a time over said first conveyor in position to meet said container as said container is conveyed by said first conveyor from said front end to said back end.

8. A machine for applying labels to containers, said machine comprising:

a first conveyor having a front end and an opposing back end;

means proximate to said front end of said first conveyor for rotating a container conveyed by said first conveyor;

means in operative connection with said rotating means for sensing when said container rotated by said rotating means has rotated to a preferred orientation, said rotating means being responsive to said sensing means, said rotating means halting the rotation of said container when said sensing means senses that said container has rotated so that the preferred side of said container is facing said back end of said conveyor;

a magazine proximate to said first conveyor for holding a stack of labels;

means for applying adhesive to each label of said stack of labels;

means proximate to said first conveyor for transferring said each label from said magazine, past said applying means and over said first conveyor to meet said front of said container as said container is conveyed by said first conveyor; and a pair of opposing label gates positioned over said first conveyor, said label gates receiving a next label from said transferring means and holding said next label over said first conveyor until said container meets said next label.

9. The machine as recited in claim 8, further comprising rollers proximate to said back end of said first conveyor for pulling said each label tightly against said container.

10. The machine as recited in claim 8, wherein said applying means includes:

a glue roller for applying a quantity of glue to said each label; and a scraper for removing excess glue from said each label.

11. The machine as recited in claim 8, wherein said container has a bail, and said machine further comprises means for sweeping said bail from the front of said container to the back of said container.

12. The machine as recited in claim 8, wherein said transferring means further comprises at least one feed roller and at least one pivoting back pressure roller.

13. A machine for applying labels to containers, said machine comprising:

a first conveyor having a front end and an opposing back end;

a second conveyor;

a third conveyor opposing and spaced apart from said second conveyor, both said second and said third conveyors being oriented at right angles with respect to said first conveyor and being parallel to each other so that a container can pass therebetween when being conveyed by said first conveyor, said second and said third conveyors being positioned near said front end of said first conveyor;

means for controlling the speeds of said first, said second and said third conveyors so that said first and said second conveyors can move at different speeds and at the same speed, said first and said second conveyors rotating containers carried by said first conveyor when said first and said second conveyors are moving at different speeds and are engaging the sides of said container;

means in operative connection with said second and said third conveyors for sensing when said container being rotated by said second and said third conveyors has rotated to a preferred orientation, said second and said third conveyors being responsive to said sensing means, said controlling means moving said second and said third conveyors at the same speed to halt the rotation of said container as soon as said sensing means has sensed that said container has rotated far enough so that the front of said container is facing said back end of said conveyor;

means in spaced relation to said first conveyor for applying a label to the preferred side of said container; and a pair of opposing label gates positioned over said first conveyor proximate to said back end of said first conveyor, said label gates receiving a next label from said applying means and holding said next label over said first conveyor until said container meets said next label.

14. The machine as recited in claim 13, wherein said applying means further comprises:

a magazine proximate to said first conveyor for holding a stack of labels;

means for applying adhesive to each label of said stack of labels; and means proximate to said first conveyor for transferring said each label from said magazine, past said applying means and over said first conveyor to meet said front of said container as said container is conveyed by said first conveyor.

15. The machine as recited in claim 13, wherein said container has a bail and said machine further comprises means for sweeping said bail from the front of said container to the back of said container.

16. The machine as recited in claim 13, wherein said applying means includes:

a roller for rolling a quantity of glue onto said each label; and a scraper for scraping excess glue from said each label.

17. The machine as recited in claim 13, further comprising rollers proximate to said back end of said first conveyor for pulling said each label tightly against said container after said label has been applied to said container.

* * * * *